United States Patent [19]

Seres

[11] Patent Number: 4,657,255

[45] Date of Patent: Apr. 14, 1987

[54] PYRAMID SHAPED PUZZLE

[76] Inventor: Zoltan S. Seres, 118 N. Viceroy Ave., Azusa, Calif. 91702

[21] Appl. No.: 808,359

[22] Filed: Dec. 12, 1985

[51] Int. Cl.[4] ..... A63B 67/14

[52] U.S. Cl. ..... 273/113; 273/111; 273/153 S

[58] Field of Search ..... 273/113, 112, 153 R, 273/153 S, 241, 242, 111, 157 A

[56] References Cited

U.S. PATENT DOCUMENTS

| | | | |
|---|---|---|---|
| 932,845 | 8/1909 | Clover | 273/113 |
| 2,261,804 | 11/1941 | Hall | 273/113 |
| 3,488,052 | 1/1970 | Weisbecker | 273/236 |
| 3,785,651 | 1/1974 | Smith | 273/113 |
| 3,840,234 | 10/1974 | Felsten | 273/113 |
| 3,994,076 | 11/1976 | Bertman | 273/111 |
| 4,025,075 | 5/1977 | Priska et al. | 273/278 |
| 4,376,537 | 3/1983 | Yokoi | 273/113 |

FOREIGN PATENT DOCUMENTS

| | | | |
|---|---|---|---|
| 8400307 | 2/1984 | PCT Int'l Appl. | 273/113 |
| 11829 | of 1899 | United Kingdom | 273/112 |
| 1506663 | 4/1978 | United Kingdom | 273/153 R |
| 2,113,106 | 8/1983 | United Kingdom | 273/113 |

*Primary Examiner*—Leo P. Picard
*Assistant Examiner*—Gary Jackson
*Attorney, Agent, or Firm*—Thomas I. Rozsa

[57] ABSTRACT

A pyramid-shaped puzzle including a plurality of maze-panels intermediate the vertex and base of the pyramid, each maze-panel having a plurality of holes through it. One or more balls is dropped through an opening in the vertex and the puzzle is manipulated by a player to guide the ball to a designated location in the base.

5 Claims, 7 Drawing Figures

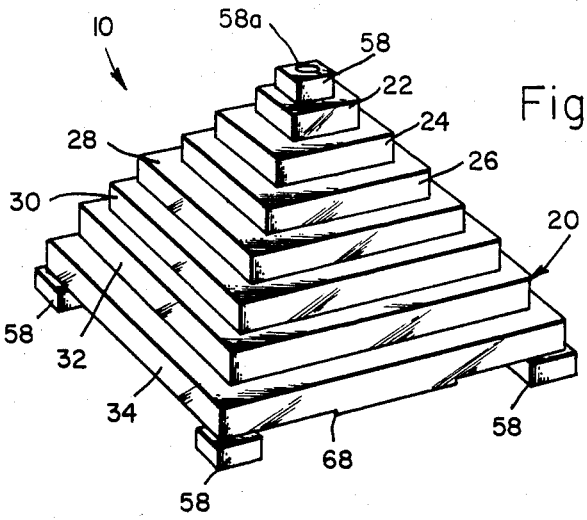
Fig. 1.
Fig. 5.
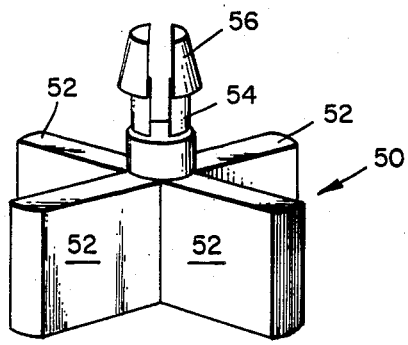
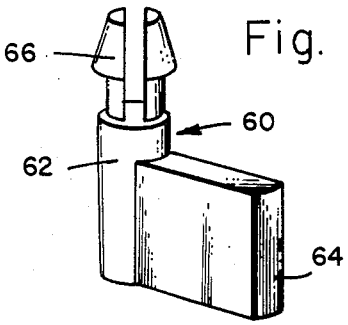
Fig. 6.
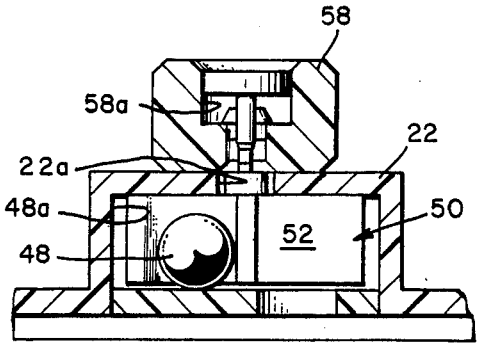
Fig. 7.
Fig. 3.
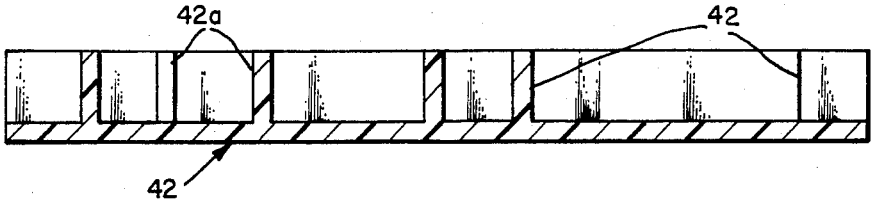

PYRAMID SHAPED PUZZLE

BACKGROUND OF THE INVENTION

1. Field of the Invention

The present invention relates to hand-held puzzles. More specifically, the present invention relates to a pyramid-shaped puzzle having one or more maze-panels intermediate its vertex and base, with each maze-panel having a plurality of holes in it. The puzzle is solved by manipulating the puzzle so that a ball rolls through the maze of each maze-panel and through a specified hole in each maze-panel until the ball reaches its designated home-base.

2. Description of the Prior Art

Hand-held puzzles that require mechanical manipulation of some parts to arrive at some prescribed solution are well known in the prior art. These puzzles include, for example, Rubic's Cube, which requires complex manipulations of nine square panels on each side of the cube through simultaneous rotation of three contiguous panels on four cube sides to achieve a configuration in which each side of the cube is entirely one color. This puzzle and others of related design tend to be very difficult for most people to solve. Consequently, players tend to find them frustrating and give up after only a few futile attempts to solve them.

Other hand-held puzzles include devices that resemble, for example, miniature pin ball machines and require manipulation of one or more balls around various obstacles until the ball reaches an end point. These types of games tend not to be very challenging and consequently players tend to tire of them quickly.

In addition, most puzzles have only one or a small number of solutions with no method to vary the maze or solution. As a result, after a given amount of playing time, one becomes tired of the puzzle.

Therefore a significant need exists for a hand-held puzzle that is sufficiently challenging to hold a player's interest without being discouragingly complex. In addition, a need exists for a puzzle that can be changed to provide a large number of solutions, thereby maintaining a player's interest indefinitely.

SUMMARY OF THE PRESENT INVENTION

The present invention relates to hand-held puzzles. More specifically, the present invention relates to a pyramid-shaped puzzle having one or more maze-panels intermediate its vertex and base, with each panel having a plurality of holes in it. The puzzle is solved by manipulating the housing so that a ball rolls through the maze and through a hole in each maze until the ball reaches its designated home-base.

The present invention further provides a method of changing the puzzle to provide a large number of solutions, thereby maintaining interest in the puzzle, even after many plays.

Accordingly, it is an object of the present invention to provide a pyramid-shaped puzzle that many players will find stimulating and challenging, but not discouragingly complex.

It is another object of the present invention to provide a pyramid-shaped puzzle that is made from readily available materials and is relatively inexpensive to manufacture.

Another object of the present invention is to provide a puzzle that can be solved with a conceptually simple algorithm.

It is a further object of the present invention to provide a puzzle whose complexity and difficulty can be varied by requiring solution of one or more puzzle mazes simultaneously.

An additional object of the present invention is to provide a puzzle whose solutions can be changed easily, thereby providing a large number of different solution paths and maintaining continued interest in the puzzle.

Further novel features and other objects of the present invention will become apparent from the following detailed description, discussion and the appended claims taken in conjunction with the drawings.

DRAWING SUMMARY

Referring particularly to the drawings for the purpose of illustration only and not limitation, there is illustrated:

FIG. 1 is a perspective view of the exterior surfaces of a preferred embodiment of a pyramid-shaped puzzle according to the present invention.

FIG. 2*a* is a plan view of the flat panel at the top of the inside of the puzzle, for putting a ball into play.

FIG. 2*b–g* are a series of plan views of maze-panels according to the present invention.

FIG. 3 is a cross-sectional side elevational view of the pyramid puzzle.

FIG. 5 is a perspective detail view of the ball release spindle of the present invention.

FIG. 6 is a perspective view of a flag-stop according to the present invention.

FIG. 7 is a cross-sectional side elevational view of the top section of the puzzle with the ball release spindle in place.

DETAILED DESCRIPTION OF THE PREFERRED EMBODIMENT

Figure 4:
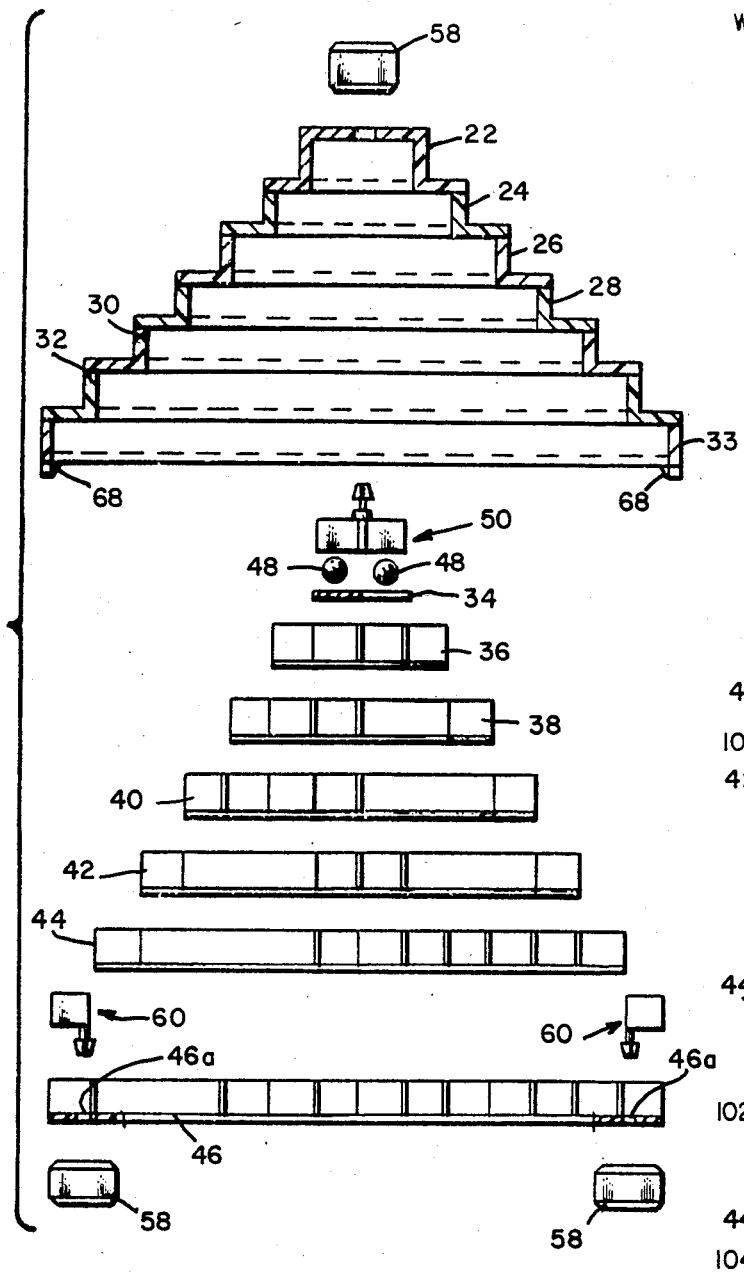
FIG. 4 is an exploded elevational view of the pyramid puzzle.
Figure 2:
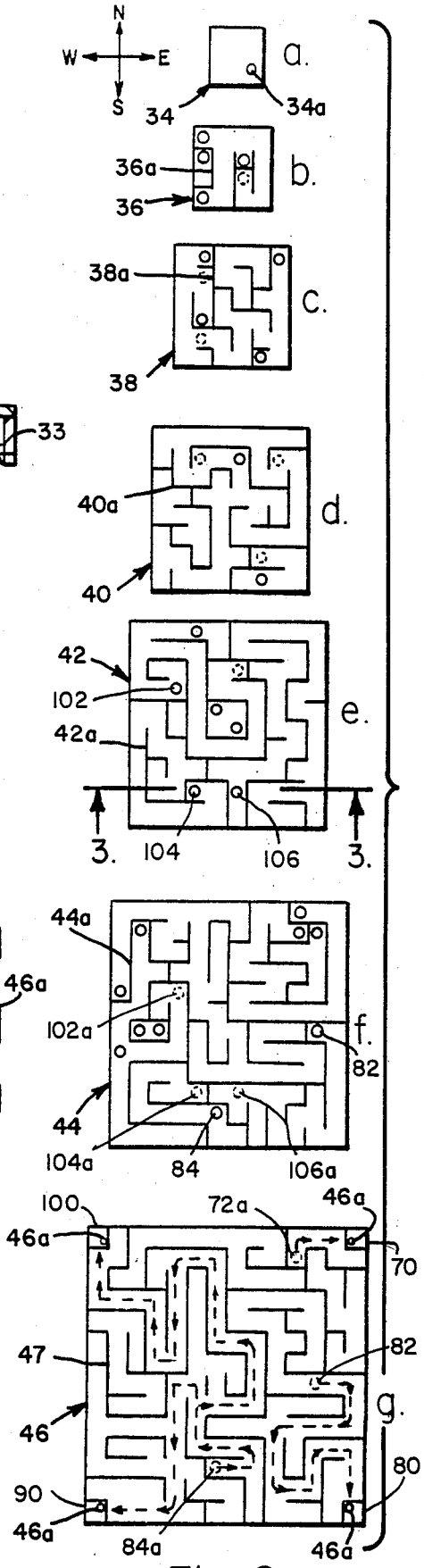

Although the apparatus of the present invention will now be described with reference to specific embodiments shown by the drawings, it should be understood that such embodiments are described by way of example only and are merely illustrative of one of many possible specific embodiments which represent applications of the principles of the invention. Various changes and modifications obvious to one skilled in the art to which the invention pertains are deemed to be within the spirit, scope and contemplation of the invention as further defined in the appended claims.

Referring to FIG. 1, puzzle 10 comprises housing 20 having seven square layers mounted one on top of each other with each succeedingly higher layer having a smaller square base then the layer below it, thereby forming a pyramid. FIG. 1 discloses a regular polyhedron having a square base. Housing 20 is a shell for holding the internal panels of puzzle 10. Accordingly, housing 20 may be cast or molded in a single piece. Transparent or translucent plastic is a good material to use in molding housing 20.

FIG. 2*b–g* illustrates a series of maze-panels; 36, 38, 40, 42, 44, and 46, respectively, in plan view, showing how the maze walls or upstanding partitions provide pathways and access holes that allow ball 48 to traverse the intricate pattern from top section 22 of housing 20 to bottom section 34. Each maze-panel includes a plurality of upstanding vertical walls, with some walls joined to others that rim perpendicular to them, forming a plurality of mazes on each maze-panel. FIG. 3 shows a cross-sectional side elevational view of a typical maze-panel construction, illustrating the relationship between a maze-panel's playing surface and upstanding partitions. Maze-panels 36, 38, 40, 42, 44, 46, including upstanding partitions, such as upstanding partitions 42*a* in FIG. 3, may be molded from a material such as plastic in one piece each, or may be formed by cementing upstanding partitions to the maze-panel base. Each maze-panel also includes a plurality of holes that ball 38 can drop through.

Construction and assembly of puzzle 10 is more clearly illustrated by the exploded view of FIG. 4. At the top of puzzle 10, ball release spindle 50, shown in greater detail in FIG. 5, includes four vanes 52 that project vertically and radially outward from shaft 54 to form four quadrants of 90° of arc each. The top portion of shaft 54 includes truncated split end 56.

To assemble puzzle 10, shaft 54 is pushed through hole 22*a* in top section 22 of housing 20 and knob 58 having a recess 58*a* for lockablely receiving truncated split end 56 of shaft 54, thereby providing a means for rotating ball release spindle 50 conveniently, to release ball 48 through hole 34*a* of flat panel 34 to initiate play of a ball.

Alternatively, housing 20 may include simply a hole at the top or vertex of the pyramid for allowing a player to drop a game-piece, such as a ball, one at a time into puzzle 10. Such construction, by eliminating ball release spindle 50 reduces construction cost and complexity. It also permits a player to choose his own game pieces, for example, a marble, which need not, strictly speaking, be sold with or be an initial part of puzzle 10, although game-pieces are required for play.

During assembly ball 48 is entrapped in top section 22 by flat panel 34, snapped into position in the bottom of top section 22. In a preferred embodiment, four balls 48 are used, one in each of the four quadrants formed by vanes 52. Then each succeeding maze-panel 36–44 is inserted in its respective order into housing 20, best illustrated in Figure 2.

Maze-panel 46, the last to be inserted, is prepared for assembly by installing flag-stops 60. Flag-stop 60, shown in FIG. 6, includes shaft 62 and one vertical vane 64 attached to shaft 62 and extending radially therefrom. The top of shaft 62 includes truncated conical split end 66, which is now inserted through holes 46*a* in each corner of maze-panel 46, with split end 66 pointing downward for locking engagement with knob 58, which has a mating recess. Knobs 58 attached to flag-stops 60 provide four feet upon which puzzle 10 stands and provide a means for rotating flag-stops 60 to lock a ball into place in its designated home-base corner to signify a successful solution and to allow a player to play more balls without having a successful ball move. When a Flag-stop 60 (FIG. 6) is employed, a vertical partition at 90 degrees to the perimeter of maze-panel 46 near a corner forms a one unit of distance wall that vane 64 rotates against, forming a small square, e.g., home-destination 100 in FIG. 2*g*. In an alternative embodiment illustrated in FIG. 2*g*, a flag-stop includes two vanes 64 at 90 degrees to each other which are rotated to form a small square in a corner of maze-panel 46 and thereby lock ball 48 into place following a solution. Now maze-panel 46 is inserted into bottom section 35 of housing 20 and is locked into place by inwardly projecting tabs 68 on the base of housing 20, thereby securing all panels within housing 20. Puzzle 10 is now ready for play.

Now that the basic structure of puzzle 10 has been described, a brief discussion of the general nature of its solution will be presented. Play is initiated by turning knob 58 (see FIG. 2) attached to ball release spindle 50 so that ball 48 falls through the only hole in flat-panel 34 to the surface of maze-panel 36. The object of playing the puzzle is to direct the ball through the maze on one level until the ball falls through a hole to the next level, where the process is repeated until the ball comes to rest in a designated place in a corner of the lowest maze-panel, i.e., maze-panel 46.

Many challenging variations of this basic objective are possible and are embodied in puzzle 10. First, as the maze-panels get larger, they also become more complex, so that it is more difficult to navigate through the maze. Second, each maze-panel may have more than one separate maze and each maze-panel may have more than one hole, as is the case in the preferred embodiment described herein. Third, one or more holes in a maze-panel may align with a maze immediately below that does not and cannot lead to a designated solution, as is the case in the preferred embodiment described herein. Fourth, more than one ball may be played at the same time with each ball having a different home destination and only one route to reach it. In the embodiment described herein, four balls may be used, each having a different color, and each having a different home destination, one in each corner of the base, whose color matches the color of one of the balls. Fifth, the solutions to puzzle 10 can be changed easily to prevent loss of interest in the puzzle by removing the maze-panels and rotating one or more of them in their original plane by 90°, 180°, or 270°, thereby changing the alignments of drop-through holes and the mazes immediately below. Some orientations may lead to a puzzle configuration, without a solution, which may further increase the time the puzzle may hold a player's interest. To begin a new game, the player simply inverts puzzle 10 and manipulates it so that balls 48 fall through holes in maze panels and move back to top section 22. This is fast and easy relative to playing the game since there are no mazes on the bottom surfaces of the maze-panels.

Flat panel 34 includes hole 34*a* for allowing a ball to fall into puzzle 10 when ball release spindle 50 is rotated, thereby initiating play. In the preferred embodiment, four balls are contained in housing 24 over flat panel 34, one in each chamber defined by vanes 52 of ball release spindle 50 and the outer walls of housing 20. If spindle 50 is rotated so that no ball is directly over hole 34*a*, all four balls will be locked within housing 20. Upon rotation so that a ball 48 is over hole 34*a*, ball 48 drops into uppermost maze-panel 36 and the game begins.

Flat panel 34 and maze-panels 36–46 are all oriented as shown in the drawings and it is useful to describe each as having north, south, east and west sides, where these directions are oriented as are the directins of a conventional map. As shown in FIG. 2*a*, hole 34*a* is located in the southeast quadrant of flat panel 34.

Referring to FIGS. 2*a–g*, a plan view of each successive maze-panel is shown, depicting the various holes and maze segments in each maze-panel. In FIGS. 2*a–g*, interior solid lines represent upstanding partitions that form the maze, solid-line circles represent holes in the respective maze-panel, dotted-line circles represent holes in the maze-panel above the maze-panel depicted that serve to advance play toward solution of puzzle 10, and dotted lines 2 trace the path from a starting position such as a landing site from one maze-panel through that maze to a hole that leads on down to a lower maze-panel, and ultimately to an ending position that is a solution.

Holes in one maze-panel that are not represented by dotted-line circles in the maze-panel below it only allow the ball to fall into deadend portions of the maze that will not lead to a solution. There are many deadends in the preferred embodiment described herein and to verbally describe each maze-panel and all possible routes between adjacent maze-panels would be tedious and repetitious and would not significantly advance understanding of the invention. Therefore, these relationships will be described only with reference to maze-panels 44 (see FIG. 2*f*) and 46 (see FIG. 2*g*).

Maze-panel 46 includes four home destinations, 70, 80, 90 and 100, and three dotted-line circles 72, 82 and 84, indicating the existence of three unique entry points from maze-panel 44 that will lead to solution of puzzle 10 if the indicated paths as shown in FIG. 2*g* are followed. Maze-panel 44 (FIG. 2f) includes eleven holes (solid-line circles), allowing eleven entry points to maze-panel 44, eight of which lead to deadend mazes. Hole 72 in maze-panel 44 allows a ball to fall to the corresponding landing site 72*a* in panel 46, from where it can reach home destination 70 by moving one unit north and three units east, where a unit of distance is the distance between adjacent parallel maze walls, i.e., upstanding partitions. This unit of distance is uniform within all maze-panels. Similarly, hole 82 in panel 44 allows a ball to fall to landing site 82*a* from where it will reach home destination 80 by moving two units east, two units south, three units west, three units south, two units east, one unit north, two units east and three units south. Home destinations 90 and 100 in maze-panel 46 can both be reached from landing site 84*a*, which corresponds to hole 84 in maze-panel 44. Therefore, the routes from landing site 84*a* to home destinations 90 and 100 have some common portions. Maze-panel 44 includes eleven holes of which solutions result from falling through holes 72, 82, and 84. Deadends result from allowing a ball to fall through any other holes, as can be verified by tracing out the paths the maze permits.

Dotted-line circles represent landing sites 102*a*, 104*a* and 106*a* on maze-panel 44, which correspond to holes 102, 104, and 106 in maze-panel 42 (FIG. 2*e*). Thus of the six holes in maze-panel 42, only half lead toward a solution of puzzle 10 and the other half are deadends. Similar analysis can be made for each route and each panel, but it is believed that the illustrations provided and accompanying drawings are sufficiently detailed to permit a person skilled in the art to practice the invention.

The game is more exciting if a player is required to manipulate to more than one ball simultaneously. Then the object of the game is to work the balls i.e., two to four balls, simultaneously so that the red ball falls into the red corner and the blue ball falls into the blue corner, etc. Similarly, the complexity could be increased by rotating the spindle so that all four balls (say red, blue, green, and yellow) fall into uppermost maze-panel 22 and the player must simultaneously get the colored ball into a correspondingly colored corner section or home destination.

Timed competition among players also enhances the challenge and stimulation of solving the puzzle.

Once a ball has reached a home destination or solution of its color, flag-stops 50 is rotated in order to cause vane 64 to block and lock ball 48 in the corner. This will prevent ball 48 from rattling around and interfering with additional play.

Puzzle 10 has also been described as being transparent. While this is one preferred embodiment, the challenge of the puzzle may be increased by making one or more of the faces of the pyramid opaque. If the player is unable to see the ball(s) as they fall through the maze, the difficulty and fun of the game are enhanced.

While the maze-panels have been described as being essentially rectangular in vertical cross-section and essentially square in horizontal cross-section, it is not necessary for the puzzle to be this shape. In addition to being a polyhedron having a square base, the maze-panels of the puzzle could assume other shapes and configurations. For example, a puzzle according to the present invention can easily be formed in the shape of a cube. Similarly, while the puzzle has been described as having siz maze-panels and a top section, it is within the spirit and scope of the present invention to have any number of maze-panels.

Therefore, although the preferred embodiments of the invention have been illustrated and described, it is apparent that these can be modified by those skilled in the art and that the scope of the invention is not limited to the precise details set forth.

Of course, the present invention is not intended to be restricted to any particular form or arrangement, or any specific embodiment disclosed herein, or any specific use, since the present invention may be modified in various particulars or relations without departing from the spirit or scope of the claimed invention shown and described herein, of which the apparatus shown is intended only for illustration and for disclosure of an operative embodiment and not to show all of the various forms or modifications which might embody the invention.

The invention has been described in considerable detail in order to comply with the patent laws by providing a full public disclosure of one of its forms. Such detailed description is not, however, intended in any way to limit the broad features or principles of the invention, or the scope of patent property to be granted.

What is claimed is:

1. A puzzle comprising:

a. a base having a square bottom, rigid upstanding side walls about its perimeter, a plurality of upstanding partitions forming at least one maze, and a home destination in each corner of said base;

b. a stop-flag and foot assembly inserted through each corner of said base and rotatable with respect thereto;

c. a plurality of stacked successively smaller maze-panels stacked together and to said base to form a pyramid, said maze-panels each having a square bottom, rigid upstanding side walls about their perimeter, a plurality of upstanding partitions forming at least one maze and at least one hole through each said maze-panel;

d. a flat panel having one hole therein attached to said uppermost maze panel;

e. a housing enclosing a ball release spindle having a plurality of vanes and rotatable with respect to the vertical axis of said puzzle attached to said flat panel; and f. at least one game-piece which can be maneuvered through the mazes of said respective maze-panels and holes to reach a designated home destination.

2. A puzzle in accordance with claim 1 wherein said game-piece is a ball.

3. A puzzle in accordance with claim 1 wherein four different colored game-pieces are employed and said home destinations each have a different color that matches the color of one of said game-pieces.

4. A puzzle in accordance with claim 1 wherein said puzzle is constructed of transparent material.

5. A puzzle in accordance with claim 1 wherein after a game-piece has been maneuvered into a destination, said flag-stop can be rotated to lock the game-piece into the home destination.

* * * * *